US005755532A

United States Patent [19]

Nuytten

[11] Patent Number: 5,755,532

[45] Date of Patent: May 26, 1998

[54] ARTICULATING PRESSURE CONDUIT

[75] Inventor: Rene T. Nuytten, North Vancouver, Canada

[73] Assignee: Hard Suits, Inc., Canada

[21] Appl. No.: 562,562

[22] Filed: Nov. 24, 1995

[51] Int. Cl.[6] ..... B63C 11/34

[52] U.S. Cl. ..... 405/189; 405/188; 114/335

[58] Field of Search ..... 405/185, 186, 405/190, 192, 193, 194, 188, 189; 114/314, 322, 335; 285/181, 136

[56] References Cited

U.S. PATENT DOCUMENTS

| | | | |
|---|---|---|---|
| 2,746,773 | 5/1956 | Bily | 285/187 X |
| 3,987,742 | 10/1976 | Boisrayon et al. . | |
| 4,109,601 | 8/1978 | Ronnevig | 405/188 X |
| 4,117,688 | 10/1978 | Ball | 405/188 |
| 4,549,753 | 10/1985 | Nuytten . | |
| 4,611,834 | 9/1986 | Rabinovich | 285/181 X |
| 4,753,552 | 6/1988 | Karal et al. | 114/314 |
| 4,903,941 | 2/1990 | Nuytten . | |
| 4,904,117 | 2/1990 | Svenning et al. | 405/192 X |

FOREIGN PATENT DOCUMENTS

| | | | |
|---|---|---|---|
| 2144987 | 4/1982 | Germany | 405/186 |
| 1603199 | 11/1981 | United Kingdom | 405/186 |
| 1604235 | 12/1981 | United Kingdom | 405/186 |

*Primary Examiner*—Tamara L. Graysay
*Assistant Examiner*—Frederick L. Lagman
*Attorney, Agent, or Firm*—Browning Bushman

[57] ABSTRACT

A method and apparatus for connecting vessels which have equal or different internal pressures, or which are surrounded by equal or different pressures to permit transport between the connected vessels. An articulating apparatus for connecting vessels which comprises: (a) a first vessel having on one side thereof an orifice; (b) a first rotary bearing and seal associated with the circumference of the orifice; (c) a first hollow wedge shaped segment having first and second sides with a first side thereof rotationally associated with the first rotary bearing and seal; (d) a second rotary bearing and seal associated with the second side of the first hollow wedge-shaped segment; and (e) a second hollow wedge-shaped segment having first and second sides with a first side associated with the second rotary bearing and seal, the second hollow wedge-shaped segment being capable of rotation relative to the first hollow wedge-shaped segment.

14 Claims, 13 Drawing Sheets

ARTICULATING PRESSURE CONDUIT

FIELD OF THE INVENTION

This invention relates to a novel method and apparatus for joining vessels. More particularly, this invention pertains to a novel method and apparatus for connecting vessels which have equal or different internal pressures, or which are surrounded by equal or different pressures to permit transport between the connected vessels.

BACKGROUND OF THE INVENTION

A problem which occurs frequently under water, or in space, is the joining or connection of pressurized vessels that are under equal or different internal pressures, or are subjected to equal or different external pressures. For instance, a serious challenge occurs at underwater depths when attempts are made to join a rescue vessel to a disabled submarine. Often the disabled submarine is not level or upright and it is difficult or impossible to connect a rescue vehicle to the escape hatch in order to allow the crew in the submarine to be transferred into the rescue vessel, and transported to the surface.

Another problem presents itself in the joining of a personnel, transfer or workover capsule to a submerged sub-sea petroleum well head. Further problems present themselves in joining two or more pressurized vessels in the vacuum or near vacuum of space, or in the upper atmosphere, or under any condition where differential pressures are present, or extremely inhospitable temperatures are encountered.

A submarine rescue situation provides a good example of the inherent problems that must be dealt with and overcome. There are many accidental situations that may occur to cause a submarine to become disabled and unable to return to the surface. Submarines have an escape hatch fitted to the upper section of the pressure hull to allow the occupants to transfer to a rescue device, either a small submersible or a rescue bell, and be returned to the surface in that manner. The rescue device is fitted with a lower trunk, which is cylindrical or often in the shape of a partial hemisphere that has a relatively soft polymer mating gasket on its outboard edge.

U.S. Pat. No. 3,987,742, granted Oct. 26, 1976, discloses a typical apparatus and method for dealing with an underwater rescue problem. This U.S. patent discloses an air lock with a sealing ring to couple an underwater rescue craft to the escape hatch of a submarine. The air lock consists of a bell, fastened around the hatch of the craft and a jacket section shaped like a ball joint, and retained with a small amount of free play. The projecting end carries the sealing ring. The inner end of the ball joint section has a groove to accommodate the ring, sealing it against the bell. The internal circumference of the free bell end has a similar groove with a sealing ring. The space between ball joint section bell and sealing rings is filled with a lubricating fluid maintained at a pressure slightly different from the hydrostatic pressure. The constant differential between the two pressures is adjusted, so that the apparent weight of the movable jacket is neutralized to give a hydrostatic buoyancy inside the bell.

Most rescue devices have a limited ability to assume any position in the water column other than upright. The limited change in attitude of the rescue device from the vertical may be effected by the shifting of ballast air and water, the movement of a weight, or the temporary thrusting of a propulsar. In each configuration, there is inevitably some degree of misalignment between the mating surfaces of the rescue device and the disabled submarine. Beyond some range of misalignment, the rescue device cannot mate and effect a seal with the disabled submarine. The mating hatch surface of the disabled submarine is almost always "off square" in more than one plane. That is, the hull of the disabled submarine is not level fore and aft, and is rolled some degree off plumb in its circumference. Some rescue devices make use of a cable attached to the hatch of the disabled submarine to winch the rescue device down to the submarine but the rescue device is still required to move off its vertical axis in order to line up with the disabled submarine. In some cases, the physical size of the rescue device relative to the length of the mating trunk precludes joining unless the disabled submarine is close to plumb.

U.S. Pat. No. 4,549,753, granted Oct. 29, 1985, Rene T. Nuytten, discloses and claims a first form of rotary joint which is useful in underwater conditions, for example, deep-sea diving suits, and which can be constructed in such a way such that resistance to rotational movement or the potential for leakage, does not increase substantially with moderate external pressure on the joint. This rotary joint is suitable for use in conditions where the external pressures are not too great.

Preferably, the joint has a sealing member, a retaining member, and a central member disposed axially between the sealing and retaining members. The central member has an annular first end dimensioned and axially slidably mounted on a retaining end of the retaining member so as to define a first variable volume chamber therebetween. The central member also has a second end with inner and outer extending annular bearing members, each concentric with, and normally rotatably abutting a corresponding sealing surface portion on the sealing member, so as to define annular side walls of a second chamber. The second chamber is interconnected with the first chamber.

U.S. Pat. No. 4,903,941, granted Feb. 27, 1990, Rene T. Nuytten, discloses and claims a second form of pressure equalizing rotary joint which can function readily at underwater depths where external pressures are great. This novel rotary joint seeks to equalize exterior and interior pressure. This rotary joint is useful in permitting free rotary motion between two components connected by the joint in conditions where unequal pressures exist at the interior and exterior of the joint. It includes a rotary joint comprising: (a) first annular member means adapted to be connected to the end of a first tube-like object; (b) second annular member means adapted to be connected to the end of a second tube-like object; (c) intermediate member means adapted to be positioned between the first annular member means and the second annular member means and being capable of moving independently of the first and second annular member means, said intermediate member means defining a first chamber between said intermediate member and the first annular member and a second chamber between said intermediate member and said second annular member; (d) first sealing means associated with the first annular member means and the intermediate member means and adapted to seal the first chamber from the interior and exterior of the joint; (e) second sealing means associated with the second annular member means and the intermediate member means and adapted to seal the second chamber from the interior and exterior of the joint; and, (f) resilient valve means adapted to enable pressure in the first chamber and pressure in the second chamber to seek to equalize when the respective pressures are unequal.

SUMMARY OF THE INVENTION

The invention is directed to an articulating apparatus for connecting vessels which comprises: (a) a first vessel having on one side thereof an orifice; (b) a first rotary bearing and seal associated with the circumference of the orifice; (c) a first hollow wedge shaped segment having first and second sides with a first side thereof rotationally associated with the first rotary bearing and seal; (d) a second rotary bearing and seal associated with the second side of the first hollow wedge-shaped segment; and (e) a second hollow wedge-shaped segment having first and second sides with a first side associated with the second rotary bearing and seal, the second hollow wedge-shaped segment being capable of rotation relative to the first hollow wedge-shaped segment.

The first rotary bearing and seal may be connected to the orifice of the first vessel by a mating tube and flange. The second side of the second hollow wedge shaped segment can have around the circumference thereof a sealing gasket.

The first vessel can be controlled by an umbilical tether and can be propelled by propellers. Moveable grappling arms can be connected to the vessel. The grappling arms can be equipped with moveable hands at the end thereof and can be equipped with magnetic attachment devices.

The first vessel can have therein a second orifice for connection to a second side of a second hollow wedge-shaped segment of a second vessel. The second vessel can be remotely operated.

A second side of the second hollow wedge-shaped segment can have therein a hollow annular sealing ring around its circumference, the hollow annular sealing ring having a port therein for exhausting fluids from the interior of the annular sealing ring.

The relative rotational positions of the first hollow wedge-shaped segment and the second hollow wedge-shaped segment can be controlled by motors and hydraulic cylinders or by cables and pulleys.

The invention is also directed to a method for connecting vessels which have equal or different internal pressures or which are surrounded by equal or different pressures, comprising: (a) connecting a first vessel having an orifice therein, a first hollow wedge-shaped member which is rotationally associated with the orifice of the first vessel, and a second hollow wedge-shaped member which is rotationally associated with the first wedge-shaped hollow member; and (b) connecting the second hollow wedge-shaped member to an orifice in a second vessel.

The first hollow wedge-shaped member and the second hollow wedge-shaped member can be rotated relative to one another so that a side of the second hollow wedge-shaped member opposite to the orifice of the first vessel, is parallel with the orifice.

The first hollow wedge-shaped member can be rotated relative to the second hollow wedge-shaped member so that a side of the second hollow wedge-shaped member opposite the orifice of the first vessel is at an angle of about 45° relative to the orifice of the first vessel.

The first vessel can have therein a second orifice, and the second orifice of a second wedge-shaped member of a third vessel can be connected to the second orifice of the first vessel.

BRIEF DESCRIPTION OF THE DRAWINGS

In drawings which illustrate specific embodiments of the invention, but which should not be construed as restricting the spirit or scope of the invention in any way:

FIG. 1 illustrates a side-section view of an articulating pressure conduit according to the invention.

FIG. 9*a* illustrates a side view of a submersible rescue vehicle and articulating conduit being lowered by an umbilical tether.

FIG. 9*b* illustrates a front view of a submersible rescue vehicle, and articulating conduit with umbilical tether, lowering a connecting tether to a disabled underwater submarine.

FIG. 9*c* illustrates a side view of a submersible rescue vehicle and articulating conduit with umbilical tether, connected to the escape hatch of an underwater disabled submarine.

FIG. 9*d* illustrates a side view of the submersible rescue vehicle and articulating conduit being raised from the underwater disabled submarine, after personnel have been transferred into the rescue vehicle.

DETAILED DESCRIPTION OF THE PREFERRED EMBODIMENT

Figure 1A:
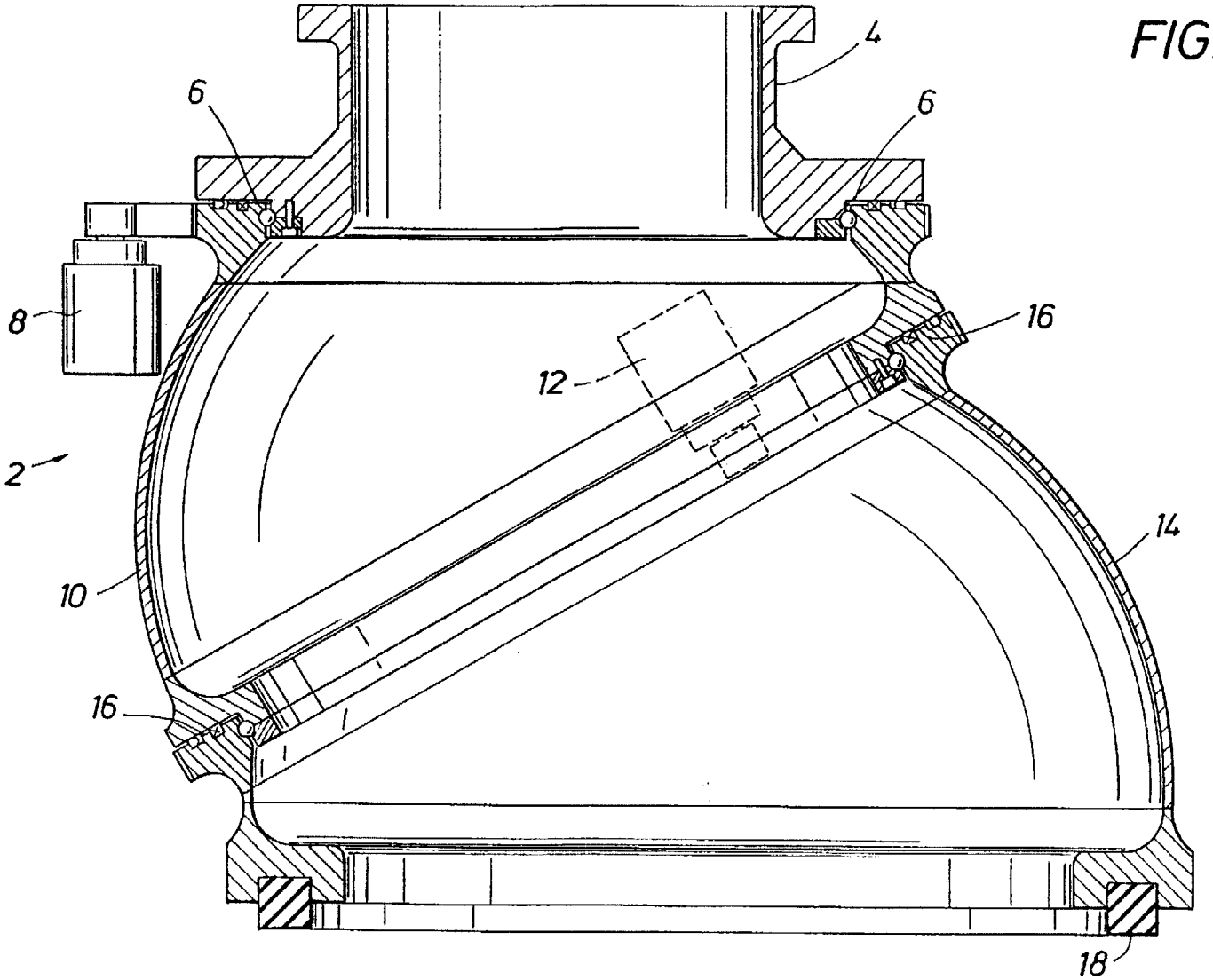
FIG. 1*a* illustrates a front view of an embodiment wherein the articulating pressure conduit is arranged so that the joining flanges provide parallel exterior connecting surfaces.

This invention relates to an apparatus and method of joining vessels that are at equal or different internal pressures, or that are surrounded by equal or different external pressures, to effect a conduit between the vessels. The conduit can be used for the transference of men or material from one vessel to another, once a sealed connection has been made.

The conduit and its herein described embodiments have the capability to articulate so as to provide a mating flange surface that will be parallel to the target mating surface—even under a wide variety of conditions of misalignment.

This apparatus is useful, for example, in the joining of a rescue vessel to the escape hatch of a disabled submarine to allow the crew to be transferred to the surface. It is also useful in the joining of a personnel transfer or work-over capsule to a submerged sub-sea petroleum well-head, or for joining two or more pressurized vessels in the vacuum or near vacuum of space or the upper atmosphere, or any such condition where differential pressures are present. Mismatched flanges must be mated under such differential pressures or must be moved into alignment under differential pressures.

Referring to the drawings, FIG. 1 illustrates a side-section view of an articulating pressure conduit according to the invention. The articulating pressure conduit 2 is constructed of a mating tube and flange 4 which is connected by a first rotary bearing and seal 6 to the top of an upper wedge segment 10, which is hollow. The rotary orientation between the mating tube and flange 4 and upper wedge segment 10, via first rotary bearing and seal 6, is controlled by upper drive motor 8. Upper drive motor 8, by means of gears, racks, cables, hydraulic cylinders, or levers (not shown in FIG. 1, but shown later in FIGS. 10, 11, 12 and 13) rotates upper wedge segment 10 about the circular first rotary bearing and seal 6 and relative to mating tube and flange 4.

The bottom surface of hollow upper wedge segment 10 is rotationally connected to the top of lower hollow wedge segment 14 by lower rotary bearing and seal 16. The rotary orientation of lower wedge segment 14 relative to upper wedge segment 10 is controlled by lower drive motor 12. The bottom circular surface of hollow lower wedge segment 14 has a circular sealing gasket 18 about its circumference.

The apparatus 2 can use the connecting joint and seal geometry described in either U.S. Pat. No. 4,549,753, or U.S. Pat. No. 4,903,941, both of which are incorporated herein by reference. The two angled or wedge segments 10 and 14 of the conduit are rotated on pressure equalizing rotary joint surfaces 6 and 16 relative to each other to provide a deflection off a centre line. A bearing and seal assembly as described in either of these two patents is suitable required to contain or exclude pressure differentials and to transfer the load from one wedge segment of the apparatus to another, whilst still allowing rotation under extreme pressures.

The bearing and seal may be of an unbalanced type where there is no pressure differential when the segments are initially required to rotate to a parallel mating position, and the segments are not required to move after a "pump-down", or a differential pressure situation has been initiated.

Alternatively, the bearing and seal assembly can be of a balanced type, such as that described in U.S. Pat. No. 4,903,941. This design allows the conduit to continue to flex or rotate, even under relatively high pressure differentials, and to be locked in a final position mechanically rather than by the effect of pressure on the seal and bearing—which is the case in the unbalanced version.

FIG. 1*a* illustrates a front view of an orientation wherein the articulating pressure conduit is arranged so that the bottom surface of the mating tube and flange 4, and first rotary bearing and seal 6, is parallel with the bottom surface of lower wedge segment 14 and lower circular sealing gasket 18. This orientation is achieved by arranging the rotational configuration of upper wedge segment 10 and lower wedge segment 14 so that the broad sides of their respective wedge shapes are dramatically opposite to one another.

Figure 1B:
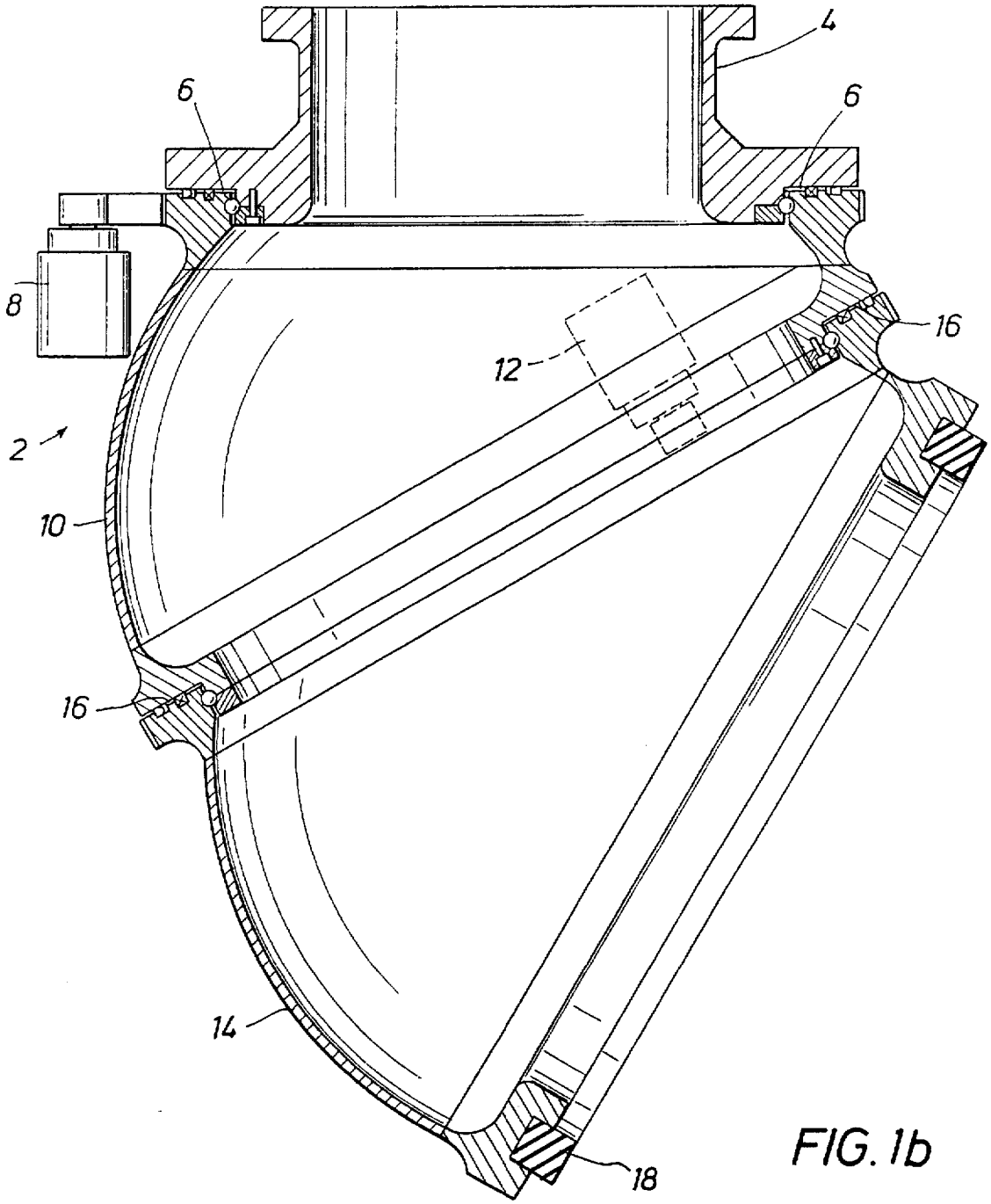
FIG. 1*b* illustrates a front view of an embodiment wherein the articulating pressure conduit is arranged so that the flanges provide exterior surfaces which are at 45° to one another.

FIG. 1*b* illustrates a front view of an orientation wherein the articulating pressure conduit 2 is arranged so that the bottom surface of the mating tube and flange 4 and the bottom circumferential surface of the lower wedge segment 14, and lower sealing gasket 18 are disposed at an angle of about 45° to one another. This orientation is achieved by rotationally configuring the broad surface of upper wedge segment 10 and the broad surface of lower wedge segment 14 so that they coincide with one another. Likewise, the thin sides of the respective wedges 10 and 14 are coincident with one another. Similarly, three wedges may be used, instead of two, to accept an offset of approximately 90°.

Figure 2:
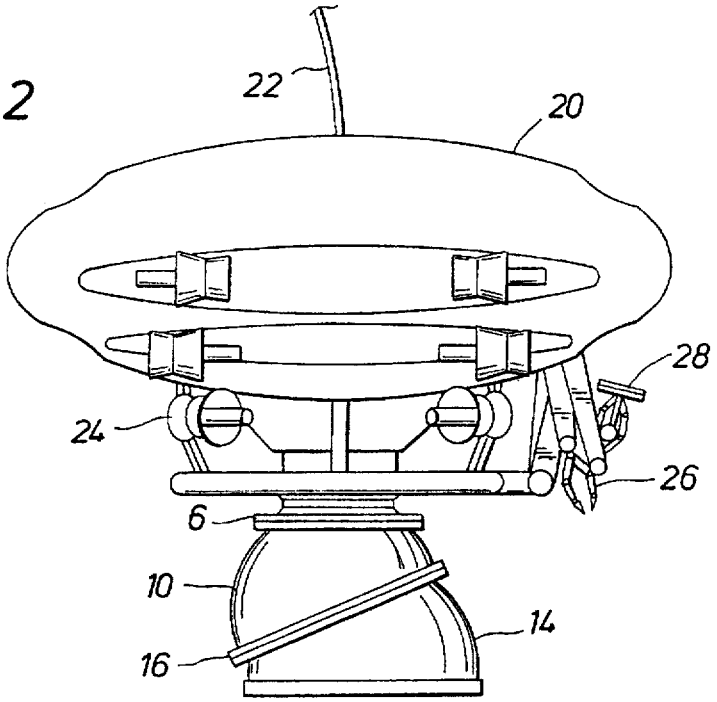
FIG. 2 illustrates a front view of an articulating conduit attached to the bottom of an autonomous submersible personnel transfer device.

In a preferred configuration, the articulating conduit is attached to the bottom of a personnel transfer device, such as a tethered diving bell or an autonomous submersible 20, as shown in FIG. 2. The wedge-shaped segments 10 and 14 are rotated so that the lower mating sealing gasket 18 is level in the normal position.

As illustrated in FIG. 2, the autonomous submersible 20 has a tether 22 which connects it to a supply vessel which is located on the surface of the water body above the autonomous submersible 20. The position of the submersible 20 is controlled by a series of propellers 24, which provide thrust in various directions, and can be controlled by the operator of the submersible 20, or from the supply vessel. The submersible 20 is equipped with extendible grappling arms 26, which have opening and closing pincers, or other means of attachment, such as suction cups, or electromagnetic feet 28, to assist the submersible 20 in connecting with a submerged vessel, as will be described in more detail below.

Figure 3:
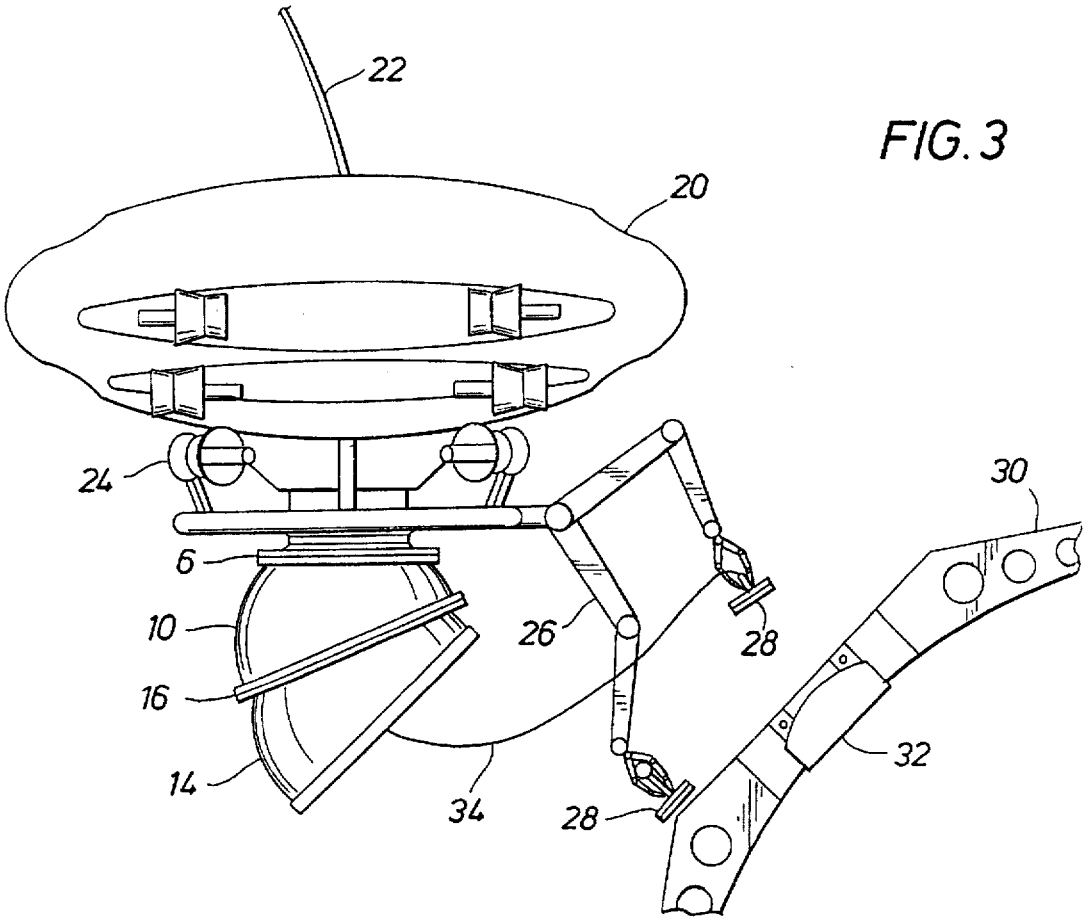
FIG. 3 illustrates a side view of an autonomous submersible personnel rescue vehicle with the articulating conduit arriving at the exterior surface of a disabled submarine.

FIG. 3 illustrates a side view of the autonomous submersible 20 with the articulating conduit comprising upper wedge segment 10 and lower wedge segment 14 at a depth where it has met with the exterior surface of a disabled submarine 30. As seen in FIG. 3, the rescue submersible 20 has arrived at the disabled submarine 30, determined that the mating surface (ie. escape hatch 32) of the disabled submarine 30 is off plumb and has attached a haul-down tether line 34 to the disabled submarine 30. Alternatively, as also illustrated in FIG. 3, the preliminary attachment link may be mechanical arms 26 and grasping claws, magnetic feet 28, or a pump/suction pod (not shown). These are employed until a seal (discussed below in association with FIG. 8) is made by pumping down the articulating conduit 2, or, in the case of a fully-equalized mating where the rescue device, disabled submarine, and ambient pressure are all the same, may be used as the primary means of attachment.

Figure 4:
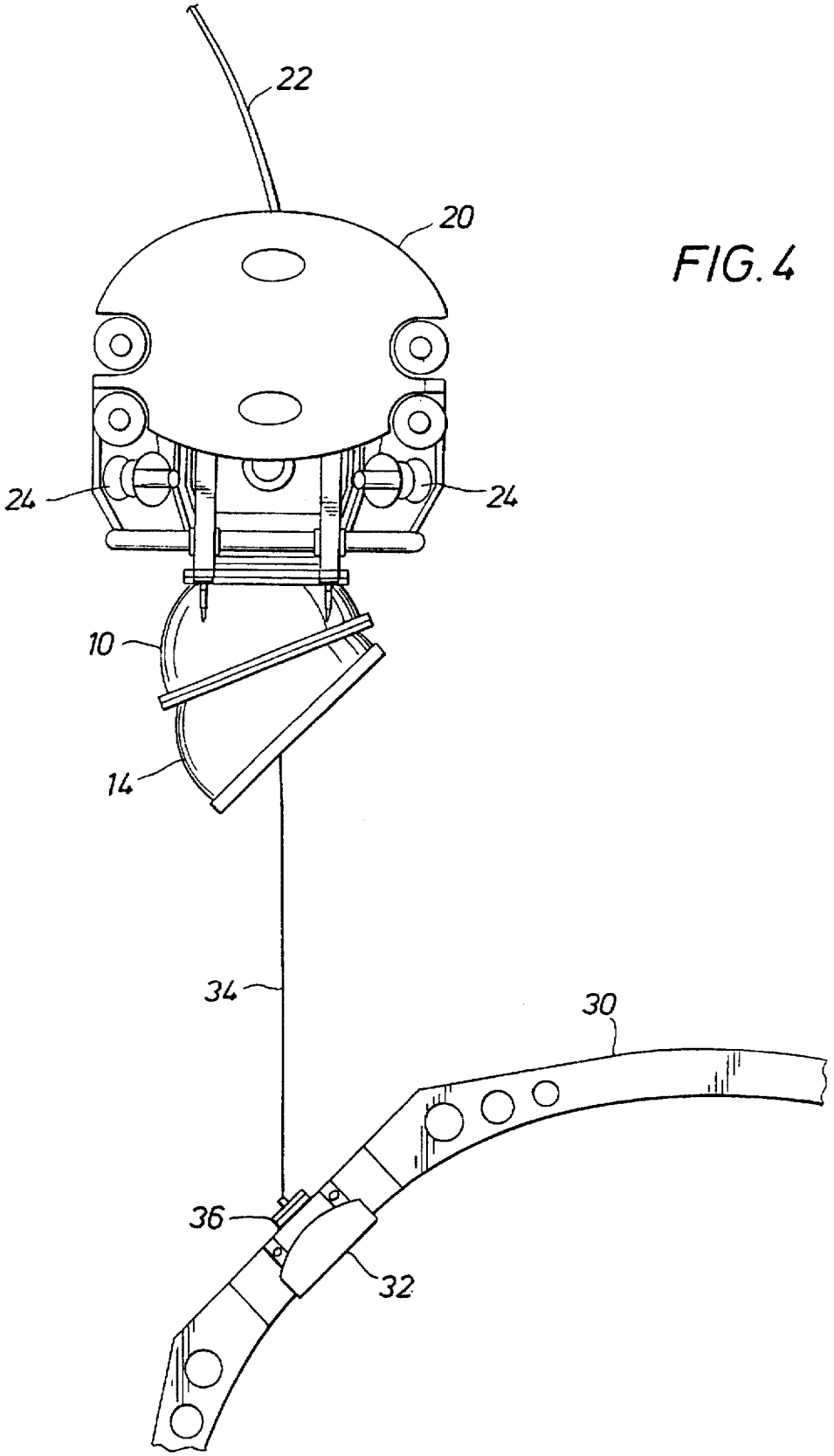
FIG. 4 illustrates a side view of an autonomous submersible personnel rescue vehicle with a connecting tether to the exterior of the disabled submarine, and the articulating conduit arranged so that the exterior surface of the conduit is parallel to the mating surface of the disabled submarine.

FIG. 4 illustrates a front view of an autonomous submersible personnel rescue vehicle with a connecting tether to the exterior of the disabled submarine, and the articulating conduit arranged so that the exterior surface of the conduit is parallel to the mating surface of the disabled submarine.

Specifically, FIG. 4 shows that the wedge-shaped sections 10 and 14 of the articulating conduit have been rotated, by the rescue submersible pilot (not shown), to bring the polymer mating gasket 18 on the bottom surface of the lower wedge segment 14 parallel to the mating surface of the escape hatch 32 of the disabled submarine 30. As seen in FIG. 4, a grappling tether 34 and electromagnetic plate 36 have been lowered to and connected with the disabled submarine 30. The tether 34 is then hauled in to bring the bottom surfaces of the lower wedge segment 14 and seal 18 adjacent to and parallel with the escape hatch 32.

Figure 5:
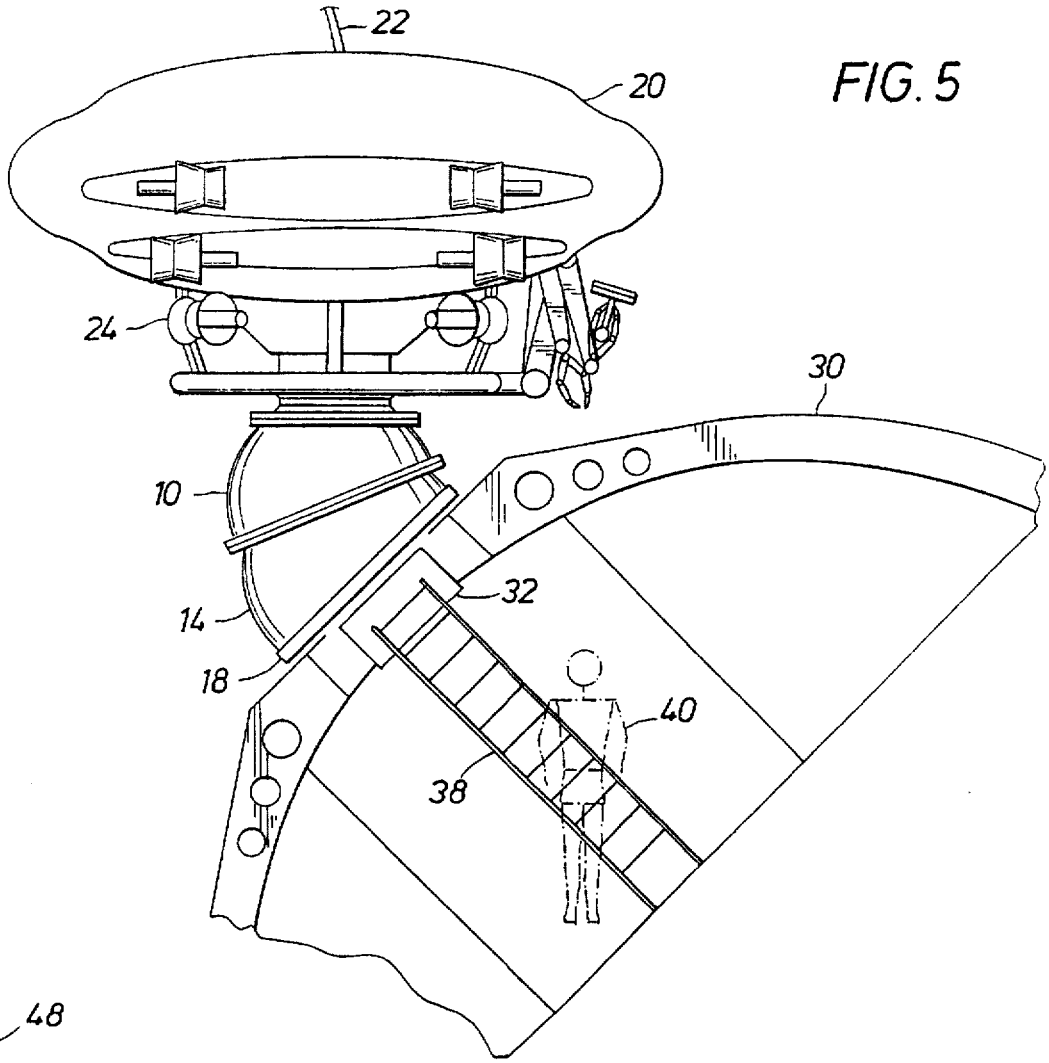
FIG. 5 illustrates a side view of the autonomous submersible personnel rescue vehicle with the articulating conduit connected to the mating surface of the disabled submarine in preparation for personnel transfer from the submarine into the rescue vehicle.

FIG. 5 illustrates a side view of the autonomous submersible personnel rescue vehicle with the articulating conduit connected to the mating surface of the disabled submarine in preparation for personnel transfer from the submarine into the rescue vehicle. As seen in FIG. 5, the autonomous submersible has been lowered by tether 22, and, by having hauled in grappling tether 34, has interfaced the lower sealing gasket 18 of lower wedge segment 14, with the parallel exterior angled surface of escape hatch 32. Once a seal is made, the segments 10 and 14 are pumped out and the escape hatch 32 can be opened. Personnel 40 can then climb the ladder 38 into the interior of lower wedge segment 14, and then into upper wedge segment 10, and finally into the interior of autonomous submersible 20. Once the appropriate number of personnel 40 have been transferred into the submersible 20, lower sealing gasket 18 is detached from escape hatch 32 and the submersible 20 is raised by tether 22 to the surface.

In an alternate embodiment, the articulating conduit may take the form of an ROV (remotely operated vehicle) fitted with thrusters, television cameras, lights, sonar, and other optical/acoustic navigation/docking electronics.

Figure 6:
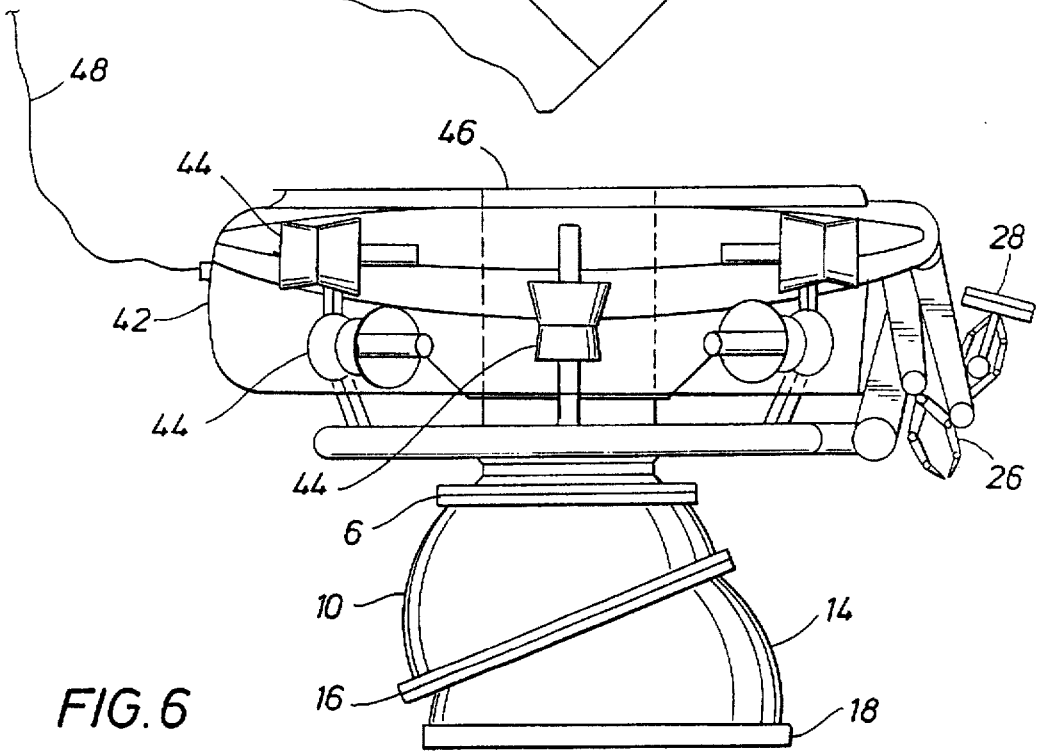
FIG. 6 illustrates a front view of a remotely operated submersible rescue vehicle with an articulating conduit on the underside of the remotely operated vehicle.

FIG. 6 illustrates a front view of a remotely operated submersible rescue vehicle (ROV) with an articulating conduit on the underside of the remotely operated vehicle. As illustrated in FIG. 6, the remotely operated vehicle 42 is navigated and controlled by a series of propellers 44, which can be angled in the directions required for propulsion in the appropriate direction. The remotely operated vehicle 42 is equipped with grappling arms 26 and magnetic feet 28. As with the submersible 20 described previously, the underside of the remotely operated vehicle 42 has connected thereto a first rotary bearing and seal 6, an upper hollow wedge segment 10, a lower rotary bearing and seal 16, and a lower wedge segment 14. A lower sealing gasket 18 is positioned around the circumference of the bottom of lower wedge segment 14. The upper surface of the remotely operated vehicle 42 is equipped with a circumferential rescue submersible mating surface 48. The remotely operated vehicle 42 is controlled from the surface via control umbilical cord 48.

In this configuration, the conduit ROV 42 is powered and controlled by an umbilical control tether 48 connected to the surface. Or it can be self-powered, for example, by batteries, and operated in an autonomous, preprogrammed mode—or in an autonomous (no umbilical tether) fashion where control is effected acoustically or optically.

The purpose of the ROV 42 is to attach the lower sealing gasket 18 of the articulating conduit 10, 14 to a disabled submarine 30 so as to provide a parallel mating surface to the arriving rescue vehicle or device. A unique advantage of the ROV 42 is the ability to couple two or more of the ROV conduit assemblies 42 together, either on the surface or on the bottom, to thereby accept very large degrees of misalignment, as can be seen in FIG. 7.

Figure 7:
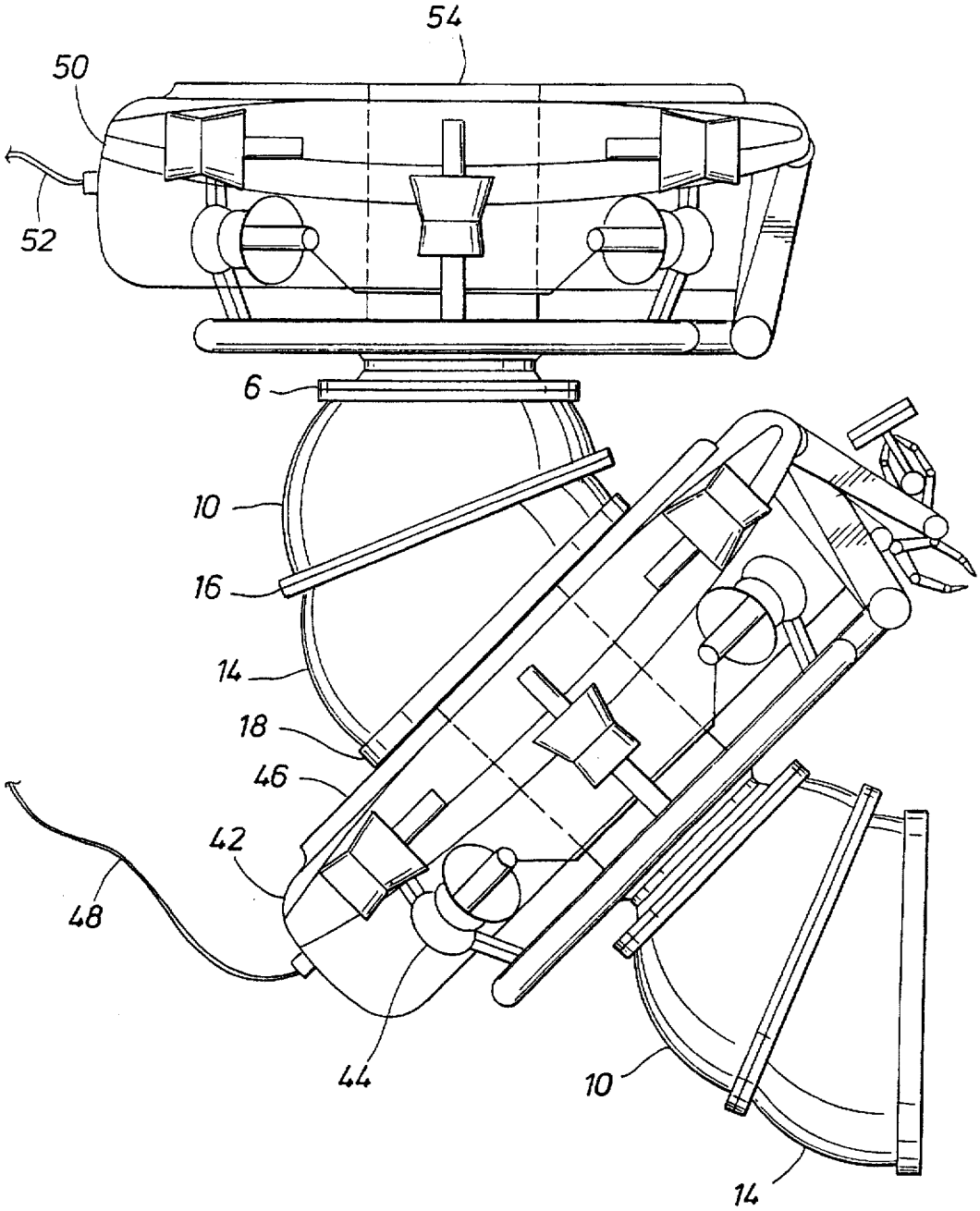
FIG. 7 illustrates a front view of an embodiment whereby two remotely operated vehicles with articulating conduits are connected in series to one another.

FIG. 7 illustrates a front view of an embodiment whereby two remotely operated vehicles with articulating conduits are connected in series to one another. As seen in FIG. 7, a lower first ROV 42 has been coupled via upper mating surface 46 with the lower sealing gasket 18 of the lower and upper wedge segment combination 10, 14, of a second ROV 50, which is controlled by a second control umbilical tether 52. It is evident in FIG. 7 that the coupling of a first ROV 42 with a second ROV 50 enables a 90° connection to be made with the escape hatch of a disabled submarine, or some other underwater sea vessel. The combination illustrated in FIG. 7 would be useful where the disabled submarine has turned on its side and the escape hatch faces in a horizontal rather than an upright direction. It will be understood that three or more ROV 42 units can be connected in series with one another to accommodate greater degrees of offset. For example, the submerged vessel may be inverted and access must be made underneath. In that case, several ROV units may be hooked together in series to provide a "U" configuration.

In the ROV mode, the articulating conduit 2 must have some means of attaching to the disabled submarine hull 30 in a secure fashion prior to the arrival of the rescue device 42. The ROV 42 may be fitted with a top hatch (not shown) so that it can be pumped down and held in position by outside sea water pressure (as is normally the case with the rescue device) or it may be held in position by any of the mechanical, magnetic, or pump-down devices previously mentioned.

Figure 8:
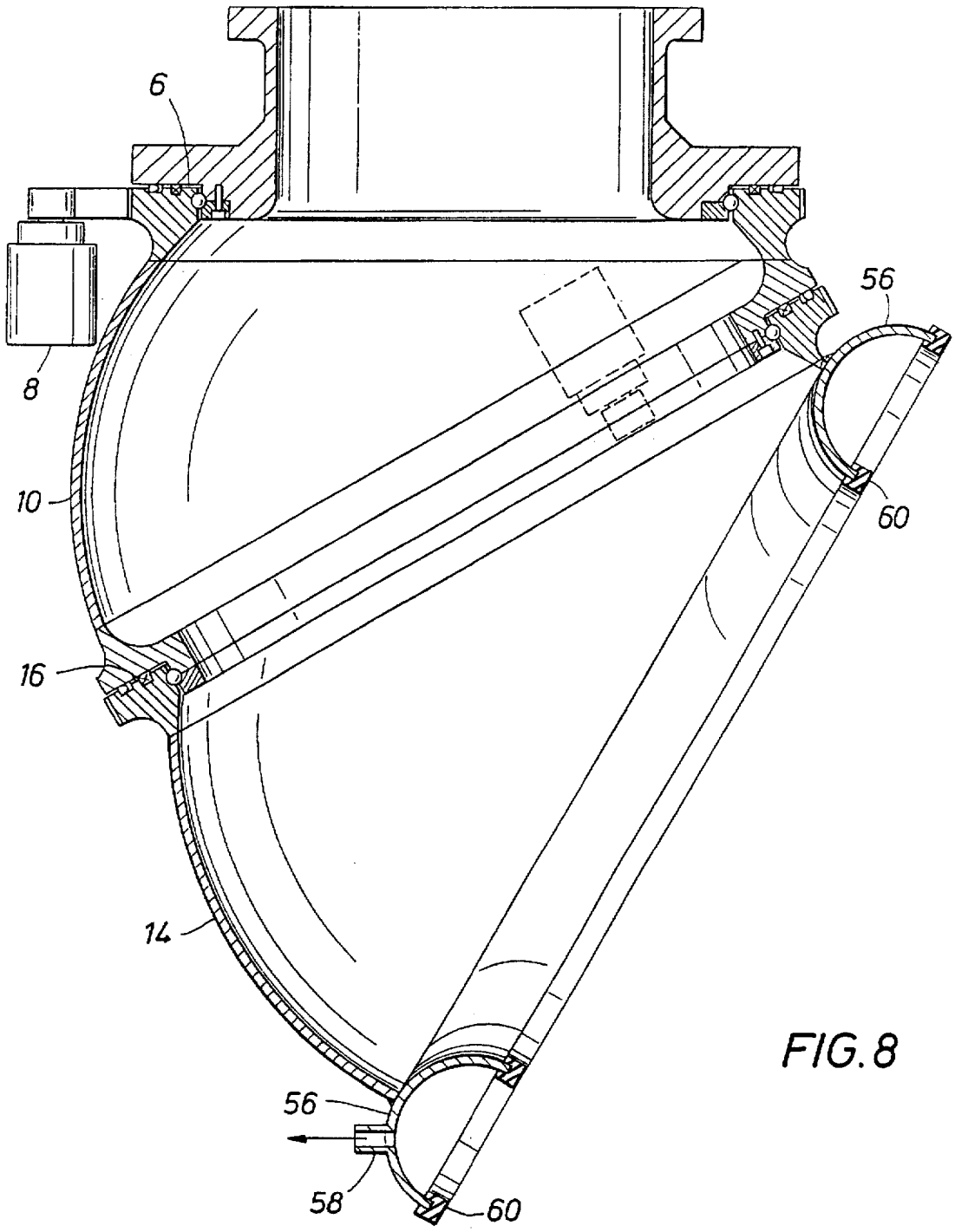
FIG. 8 illustrates a detailed section view of the articulating components of the articulating conduit, including the annulus seal arrangements.

As an alternative to any of these hold-down methods, the conduit ROV may have a lower seal that has two concentric polymer rings with an annulus between them. FIG. 8 illustrates a detailed section view of the articulating components of the articulating conduit, including the annulus seal arrangement. As seen in FIG. 8, the annulus seal 56 replaces the conventional lower sealing gasket 18, as illustrated in FIG. 1, with a cupped ring configuration 56 which has a pump exhaust port 58. A pair of concentric polymer sealing rings 60 are fitted onto the exterior edges of the hollow ring 56. Once the annulus seal 56 has engaged the surface of the escape hatch of the disabled submarine, or other suitable surface, and the seals 60 are engaged, a vacuum is drawn on the interior of seal 56 by exhausting the contents through pump exhaust port 58.

The annulus seal is pumped down in basically the same fashion as the manner in which the entire trunk is pumped down in the rescue device mode, and the conduit ROV is held firmly in position by outside sea water pressure.

Figure 9A:
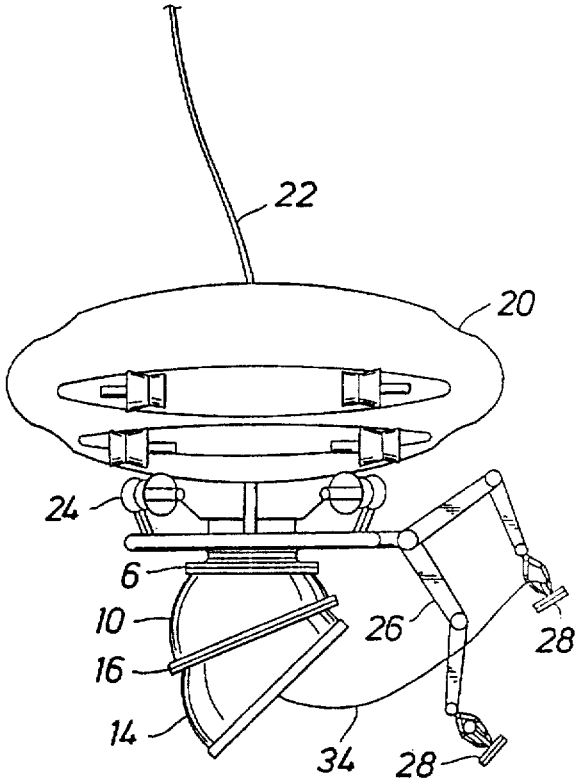
FIGS. 9*a* to 9*d* illustrate sequential views.

FIG. 9*a* illustrates a side view of a submersible rescue vehicle and articulating conduit being lowered by an umbilical tether. As seen in FIG. 9*a*, the grappling tether 34 is held by grappling arm 26, and is ready for dropping at the appropriate moment, by a control command transmitted through umbilical tether 22.

Figure 9B:
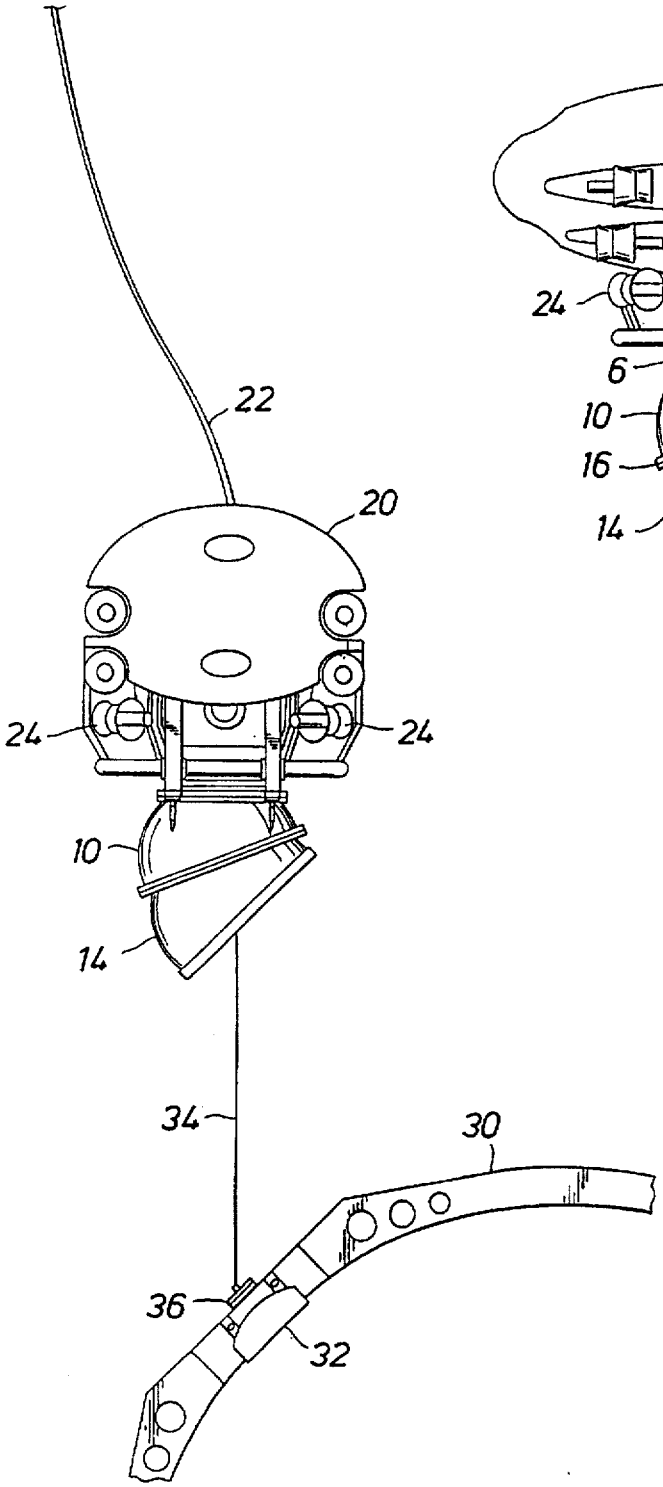

FIG. 9*b* illustrates a front view of a submersible rescue vehicle, and articulating conduit with umbilical tether, lowering a connecting tether to a disabled underwater submarine. As seen in FIG. 9*b*, the grappling tether 34, with a magnetic plate 36 at the lower end thereof, has been dropped ready for engagement with the external surface of escape hatch 32 of disabled submarine 30.

Figure 9D:
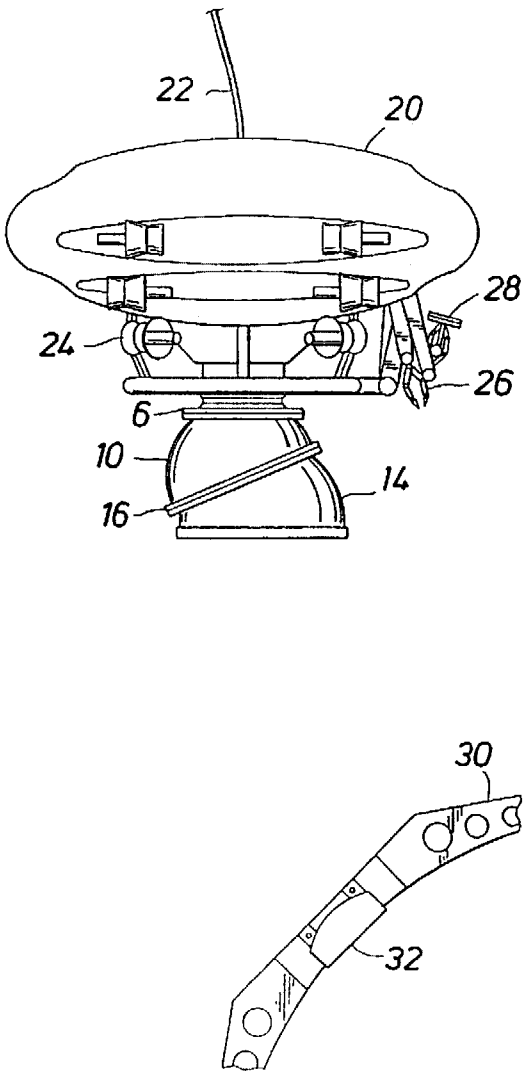
Figure 9C:
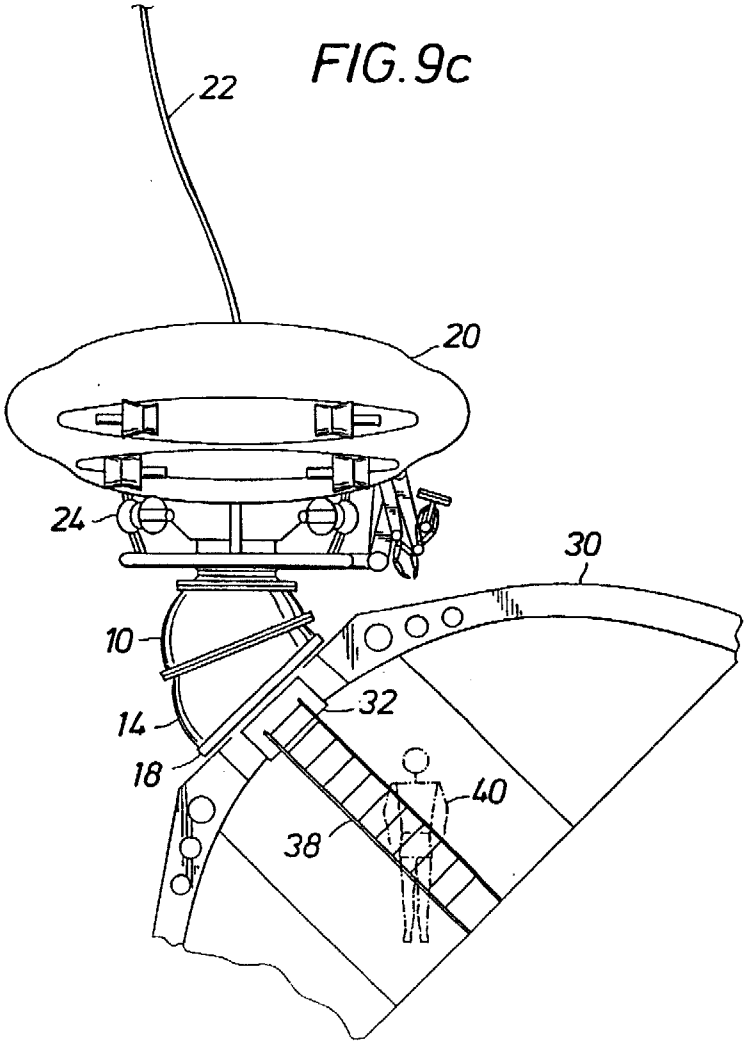

FIG. 9*c* illustrates a side view of a submersible rescue vehicle and articulating conduit with umbilical tether, connected to the escape hatch 32 of an underwater disabled submarine. In the position illustrated in FIG. 9*c*, the grappling tether 34 has been hauled into the interior of conduit 10, 14, which is now engaged with the external surface of escape hatch 32 of disabled submarine 30. Once pressures are equalized internally, and sea water is pumped from the interior of conduit 10, 14, the escape hatch 32 can be opened, and personnel 40 can be evacuated via ladder 38 through the interior of conduit assembly 10, 14, into the interior of submersible 20.

FIG. 9*d* illustrates a side view of the submersible rescue vehicle 20 and articulating conduit 10, 14 being raised from the underwater disabled submarine 30, after personnel have been transferred into the rescue vehicle 20.

Figure 10:
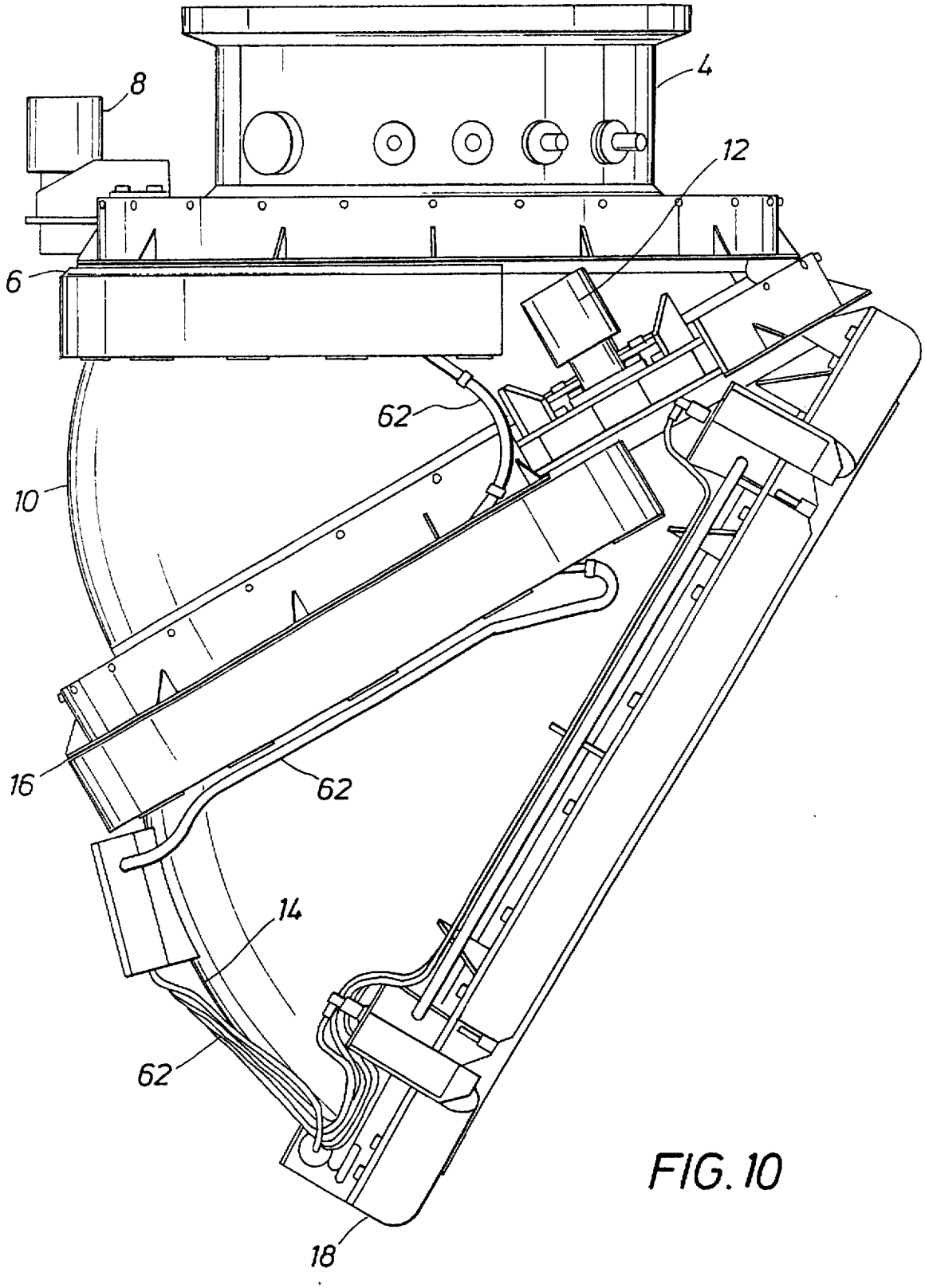
FIG. 10 illustrates a detailed front view of the power accessories which operate an articulating conduit.

FIG. 10 illustrates a detailed front view of the power accessories which operate the articulating conduit. As seen in FIG. 10, an upper drive motor 8, which can be hydraulic or electrical, rotationally drives mating tube and flange 4, via first rotary bearing and seal 6, relative to upper wedge segment 10. In similar fashion, lower drive motor 12 rotationally drives the lower wedge segment 14 via lower rotary bearing and seal 16, relative to upper wedge segment 10. Hydraulic hoses and water pumping hoses 62 are shown connected to various points on the whole upper wedge segment 10, lower wedge segment 14 assembly. These hoses, and other equipment, are conventional and do not represent part of the invention. They enable the relative rotational positions of the upper wedge segment 10 to be adjusted relative to mating tube and flange 4, and in turn, lower wedge segment 14, to be positioned relative to upper wedge segment 10, via lower rotary bearing and seal 16. Furthermore, some of the hoses are used to pump sea water from the interior of upper wedge segment 10 and lower wedge segment 14, once a water-tight seal has been made between lower sealing gasket 18 and the escape hatch of a disabled submarine, as explained previously in detail. The lower sealing gasket 18, in an alternative form, can be the annulus seal 56, which was illustrated in FIG. 8. FIG. 10 also shows various nipples, and other connections, to which hoses and the like can be connected for pumping air into the interior of the conduit assembly 10, 14, exhausting water from the interior of the assembly and performing other functions required to operate the conduit assembly 10, 14.

Figure 11:
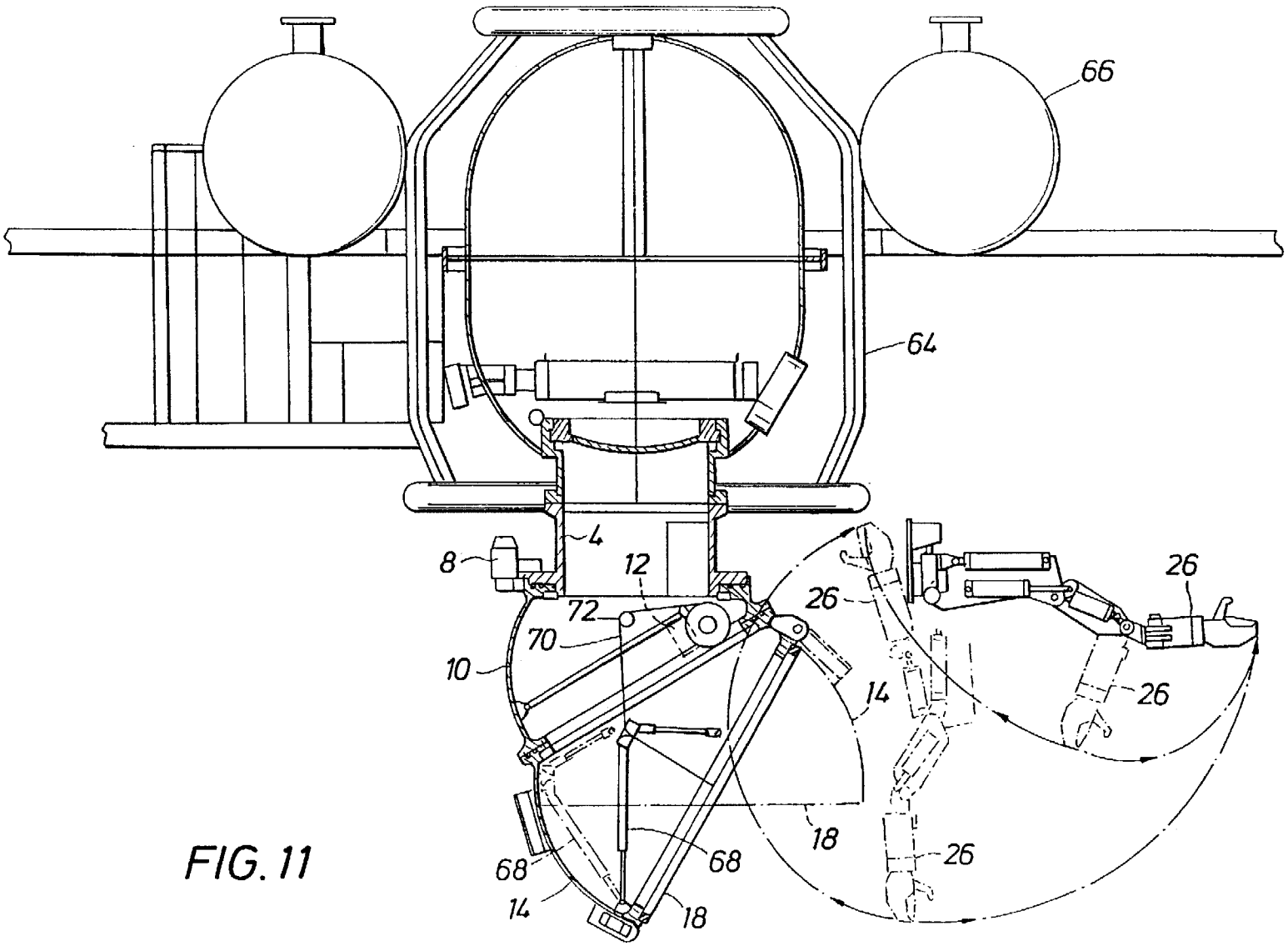
FIG. 11 illustrates a detailed front section view of a distinctive embodiment of a thrust-powered submersible rescue vehicle, with articulating conduit, grappling accessories, variable ballast and power accessories which operate the articulating conduit.

FIG. 11 illustrates a detailed front section view of an alternative embodiment of an autonomous submersible rescue vehicle, with articulating conduit, grappling accessories, and power accessories which operate the articulating conduit. As seen in FIG. 11, the submersible 64 is equipped with a pair of buoyancy tanks 66. The upper and lower wedge segments 10, 14 are connected to the underside of the submersible 64, via mating tube and flange 4, as described previously in association with prior drawings.

FIG. 11 illustrates by means of a network of hydraulic cylinders 68, cable 70, and pulley 72, as controlled by hydraulic pumps, or motors, or alternatively, pneumatic pumps, and motors, how the lower wedge segment 14 can be rotated relative to upper wedge segment 10, via lower rotary bearing and seal 16, between a range of rotational orientations whereby in one position, the lower sealing gasket 18 is at approximately a 45° angle relative to the horizontal bottom of submersible 64, to another opposite position where the lower sealing gasket 18 is horizontal and parallel with the horizontal bottom of the submersible 64. The hydraulic cylinder 68, cable 70 and pulley 72, together with hydraulic and pneumatic motors, and electric motors, as illustrated in FIG. 11, are conventional. A motor driven rack and pinion system may also be used to affect rotation.

FIG. 11 also shows by means of arced lines the range of positions that can be assumed by grappling arms 26, which also are controlled by conventional hydraulic or pneumatic cylinders, or other suitable powering mechanisms.

Figure 12:
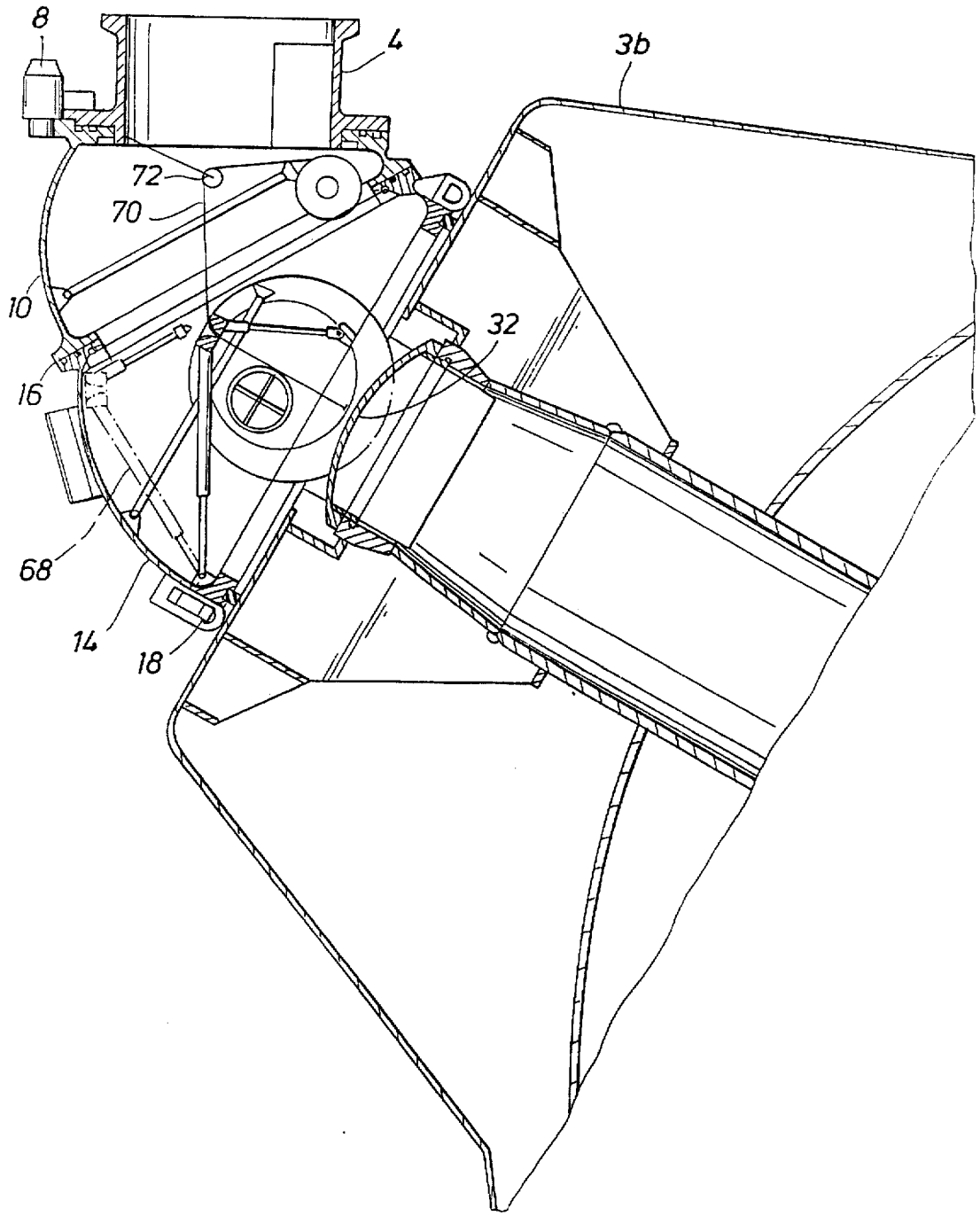
FIG. 12 illustrates a detailed section view of the components of an articulating conduit connected to the escape hatch of a disabled underwater submarine, disposed at an angle.

FIG. 12 illustrates a detailed front section view of the components of an articulating conduit connected to the escape hatch of a disabled underwater submarine, disposed at an angle. As seen in FIG. 12, the hydraulic or pneumatic cylinders 68 have rotationally moved the lower wedge segment 14 about lower rotary bearing and seal 16, relative to upper wedge segment 10, so that the lower sealing gasket 18 is parallel with and mates with the external surface of escape hatch 32 of disabled submarine 30.

Figure 13:
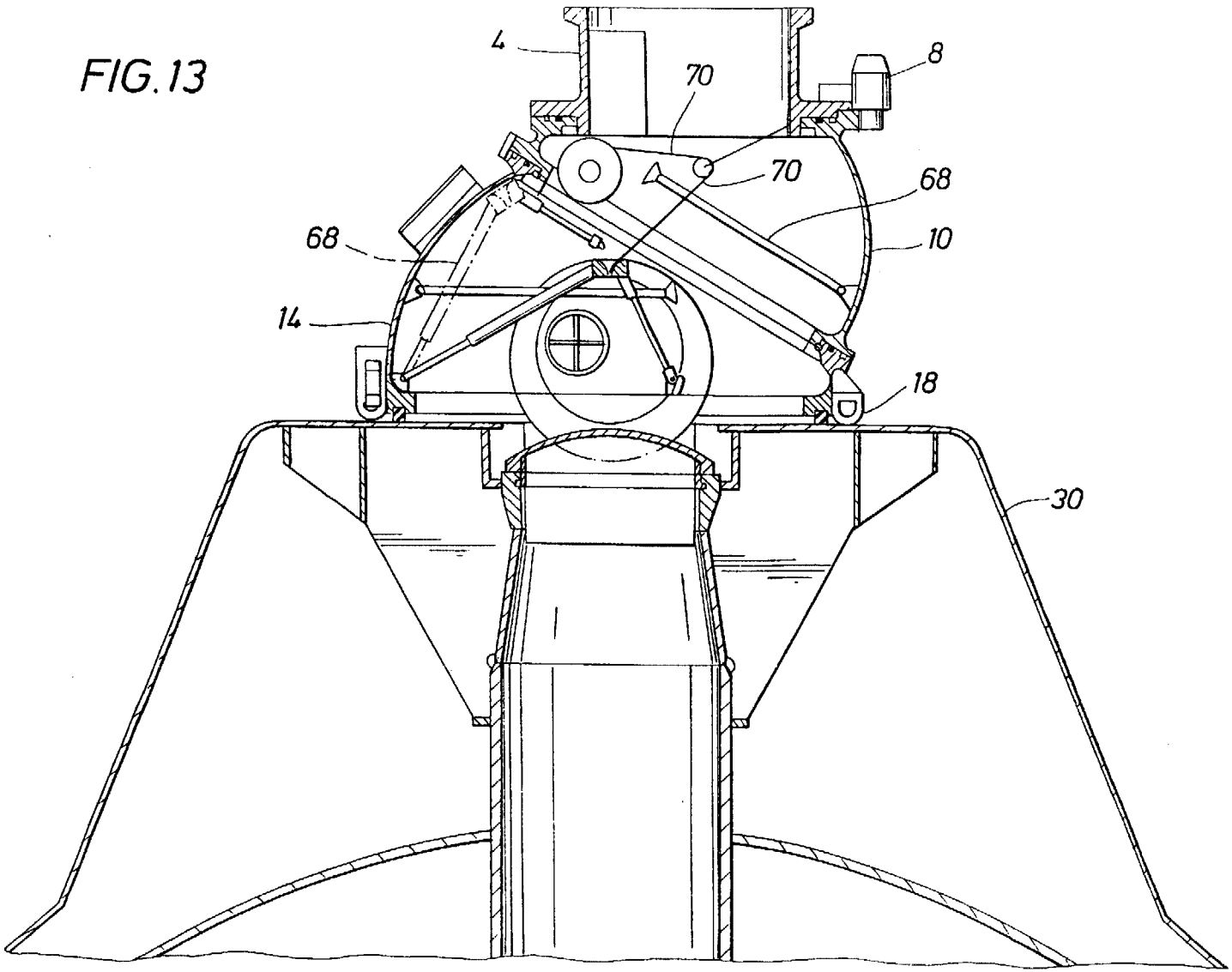
FIG. 13 illustrates a detailed front section view of the components of an articulating conduit connected to the upright escape hatch of a disabled underwater submarine.

FIG. 13 illustrates a detailed front section view of the components of an articulating conduit connected to the upright escape hatch of a disabled underwater submarine. As seen in FIG. 13, the lower wedge segment 14 has been rotated via hydraulic or pneumatic cylinders 68 and cable 70 relative to upper wedge segment 10, so that the lower sealing gasket 18 is horizontal, and mates snugly with the horizontal surface of escape hatch 32 of disabled submarine 30. The orientation illustrated in FIG. 13 would be exceptional because it would be unusual for a disabled submarine 30 to settle on the bottom of a body of sea water in a perfectly level position. However, the combination of extremes illustrated in FIGS. 12 and 13 demonstrate the versatility of the conduit combination 10, 14.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An articulating apparatus for connecting first and second vessels, such as underwater vessels that have equal or different internal pressures or that are surrounded by equal or different pressures, comprising:

a first, hollow wedge-shaped segment having first and second, open ends, said first end of said first segment being adapted to be connected to said first vessel;

a second, hollow wedge-shaped segment having first and second open ends;

a first rotary bearing and seal assembly interconnecting said first end of said second segment and said second end of said first segment, said first rotary bearing and seal assembly permitting said second segment to rotate relative to said first segment while said first and second segments are maintained in abutting relationship to one another;

said first and second segments being configured such that said second segment can be rotated from a first position wherein an imaginary, first plane passing through and parallel to the opening defined by said second open end of said second segment is transverse to an imaginary, second plane passing through and parallel to the opening defined by said first open end of said first segment to a second position wherein said first and second planes are substantially parallel.

2. An apparatus as claimed in claim 1 wherein said first segment is connected to said first vessel by a mating tube and flange.

3. An apparatus as claimed in claim 2 wherein a second rotary bearing and seal assembly interconnects said first open end of said first segment to said mating tube and flange.

4. An apparatus as claimed in claim 1 wherein the second end of the second segment has a sealing gasket around the circumference thereof.

5. An apparatus as claimed in claim 1 wherein the first vessel is controlled by an umbilical tether.

6. An apparatus as claimed in claim 5 wherein the first vessel is propelled by propellers.

7. An apparatus as claimed in claim 6 wherein the first vessel has moveable grappling arms connected to the vessel.

8. An apparatus as claimed in claim 7 wherein the grappling arms are equipped with moveable hands at the end thereof.

9. An apparatus as claimed in claim 7 wherein the grappling arms are equipped with magnetic attachment devices.

10. An apparatus as claimed in claim 1 wherein said second end of the second segment has therein a hollow annular sealing ring around its circumference, the hollow annular sealing ring having a port therein for exhausting fluids from the interior of the annular sealing ring.

11. An apparatus as claimed in claim 1 wherein the relative rotational positions of the first segment and the second segment are controlled by motors and hydraulic cylinders.

12. An apparatus as claimed in claim 1 wherein the relative rotational positions of the first and the second segment are controlled by cables and pulleys.

13. An apparatus as claimed in claim 1 wherein the relative rotational positions of the first segment and the second segment are controlled by a motor-driven rack and pinion system.

14. A method for connecting first and second vessels, such as underwater vessels that have equal or different internal pressures or that are surrounded by equal or different pressures, said first vessel having a first orifice therein, said second vessel having a second orifice therein, comprising:

interconnecting said first orifice on said first vessel to a first, hollow wedge-shaped segment having first and second, open ends, said first end of said first segment being connected to said first vessel;

connecting said first segment to a second, hollow wedge-shaped segment having first and second open ends, said first end of said second segment being connected to said second end of said first segment, a first rotary bearing and seal assembly interconnecting said first end of said second segment and said second end of said first segment, said first rotary bearing and seal assembly permitting said second segment to rotate relative to said first segment while said first and second segments are maintained in abutting relationship to one another, said first and second segments being configured such that said second segment can be rotated from a first position wherein an imaginary, first plane passing through and parallel to the opening defined by said first open end of said second segment is transverse to an imaginary, second plane passing through and parallel to the opening defined by said first open end of said first segment to a second position wherein said first and second planes are substantially parallel; and connecting the second end of said second segment to said second orifice in said second vessel.

* * * * *